US005673781A

United States Patent [19]

Costello et al.

[11] Patent Number: 5,673,781

[45] Date of Patent: Oct. 7, 1997

[54] COIN DETECTION DEVICE AND ASSOCIATED METHOD

[75] Inventors: Steven Michael Costello, St. Claire County, Ill.; Joe Lee Young, St. Louis County, Mo.

[73] Assignee: Coin Acceptors, Inc., St. Louis, Mo.

[21] Appl. No.: 551,866

[22] Filed: Nov. 21, 1995

[51] Int. Cl.[6] ..... G07D 5/02

[52] U.S. Cl. ..... 194/317; 194/334

[58] Field of Search ..... 194/317, 318, 194/319, 334

[56] References Cited

U.S. PATENT DOCUMENTS

| | | | |
|---|---|---|---|
| 3,870,137 | 3/1975 | Fougere | 194/317 |
| 3,918,563 | 11/1975 | Schwippert et al. . | |
| 3,918,564 | 11/1975 | Heiman et al. . | |
| 3,918,565 | 11/1975 | Fougere et al. . | |
| 3,952,851 | 4/1976 | Fougere et al. . | |
| 3,966,034 | 6/1976 | Heiman et al. . | |
| 4,151,904 | 5/1979 | Levasseur et al. . | |
| 4,625,852 | 12/1986 | Hoormann | 194/317 |
| 4,646,904 | 3/1987 | Hoormann | 194/334 |
| 4,664,244 | 5/1987 | Wright | 194/317 |
| 4,696,385 | 9/1987 | Davies | 194/319 |
| 4,705,154 | 11/1987 | Masho et al. | 194/318 X |
| 5,020,653 | 6/1991 | Shimizu | 194/317 |
| 5,033,603 | 7/1991 | Kai et al. | 194/334 |
| 5,076,414 | 12/1991 | Kimoto | 194/317 |
| 5,097,934 | 3/1992 | Quinlan, Jr. | 194/200 |
| 5,191,956 | 3/1993 | Ibarrola | 194/317 |
| 5,460,256 | 10/1995 | Levasseur | 194/334 |

*Primary Examiner*—F. J. Bartuska

*Attorney, Agent, or Firm*—Haverstock, Garrett & Roberts

[57] ABSTRACT

A coin detection device includes one or more optical sensors positioned along a coin path and capable of detecting movement of a coin thereby, a coil energizable to generate an electromagnetic field in the region of the coin path, a processor connected to the optical sensor or sensors so as to receive signals therefrom and connected to a detector which is capable of detecting the coin as it enters and leaves the region of the coil, the processor is operable to establish an optical size time based upon signals received from the optical sensor or sensors and a magnetic size time based upon signals received from the detector and to further establish a ratio of the magnetic size time to the optical size time, or magnetic to optical size ratio, the established ratio is then evaluated to determine if the tested coin is a valid coin.

36 Claims, 4 Drawing Sheets

COIN DETECTION DEVICE AND ASSOCIATED METHOD

FIELD OF THE INVENTION

This invention relates generally to vending machines and more particularly, to coin detection devices and coin detection methods utilized in such vending machines.

BACKGROUND OF THE INVENTION

Known coin detection devices utilize various coin detection methods including optical size detection and metallic characteristic detection. Two such coin detection devices are those disclosed in U.S. Pat. No. 4,625,852 and U.S. Pat. No. 4,646,904. It is also known to combine optical size detection and metallic characteristic detection in a single coin detection device in order to achieve greater coin detection accuracy. However, due to the similar metallic content of some coins, it is difficult to distinguish between such coins using metallic characteristic detection. In such cases, even in coin detection devices incorporating both types of coin detection, optical size detection must sometimes be relied upon to make the necessary distinction. Unfortunately, in some cases, particularly in the case of ringed coins which are coins including an interior portion formed from a first material and a surrounding outer portion formed from a second material, coins of various denominations may have similar optical sizes making it difficult to distinguish between such coins.

Accordingly, it is desirable and advantageous to provide a coin detection device capable of effectively distinguishing between coins having similar metallic content. It also is desirable and advantageous to provide a coin detection device which does not rely solely upon optical size detection to distinguish between coins having similar metallic content.

OBJECTS OF THE INVENTION

An object of the present invention is to provide a coin detection device and associated method for distinguishing between coins of similar metallic content.

Another object of the invention is to provide a coin detection device which minimizes losses resulting from inaccurate validation of coins of similar metallic content.

Another object of the present invention is to provide a coin detection device which utilizes magnetic size detection in combination with optical size detection to effectively distinguish between different coin types.

Yet another object of the present invention is to provide a method of coin detection which can be implemented using known coin validation and/or detection devices.

SUMMARY OF THE INVENTION

These and other objects of the invention are attained by a coin detection device which, in one embodiment, includes first and second spaced optical sensors positioned along a coin path and capable of detecting movements of a coin thereby. The optical sensors may be configured such that a signal from each optical sensor changes from a high (HI) state when there is no coin detected by the optical sensor to a low (LO) state when a coin is detected by the optical sensor. Such a construction is disclosed in U.S. Pat. No. 4,646,904 which is assigned to the assignee of the present invention and the disclosure of which is incorporated herein by reference. The optical sensors could also be configured to move from a LO state during non-detection to a HI state during detection. A processing means, such as a microprocessor, is connected to the optical sensors so as to receive signals therefrom. The processing means is also operable to establish an optical size time which runs from when the coin is detected by the first optical sensor to when the coin is detected by the second optical sensor. Further, the optical size time preferably runs from when the coin is first detected by the first optical sensor to when the coin is last detected by the second optical sensor. However, it is also understood that the present invention could be implemented with only one optical sensor.

The coin detection device also includes a coil which is energizable to produce an electromagnetic field in the region of the coin path. In the embodiment described herein the coil is part of a ringing circuit which is a modified version of the ringing circuit described in U.S. Pat. No. 4,625,852 which is assigned to the assignee of the present invention and the disclosure of which is incorporated herein by reference. However, the coil could be a part of numerous known coin detection apparatus or circuits such as those which utilize a coil or inductor as part of an oscillator circuit as disclosed in U.S. Pat. Nos. 3,870,137; 3,918,563; 3,918,564; 3,918,565; 3,952,851; 3,966,034; and 4,151,904. The presence of the coin in the region of, or field of, the coil of a ringing circuit or oscillator circuit causes the output of such circuits to change. Thus, the output of such circuits can be monitored through various detector means or detector circuits, such as described in the aforementioned patents, to determine the presence or absence of the coin in the region of the coil. In the coin detection device of the present invention, the processing means is connected to the detector means and is operable to establish a magnetic size time which runs from when the coin enters the region of the coil and begins to affect the field thereof, to when the coin leaves the region of the coil and no longer affects the field thereof.

Having established the optical size time and the magnetic size time, the processing means is also operable to establish either a magnetic to optical size ratio which is the ratio of the magnetic size time to the optical size time, or the reciprocal thereof. The established magnetic to optical size ratio is then evaluated in light of stored predetermined maximum and minimum ratios for the acceptable coin type or types to determine if the established magnetic to optical size ratio falls within the maximum and minimum ratios for one of the coin types. If the established magnetic to optical size ratio falls within predetermined maximum and minimum values for a valid coin, then the tested coin passes the magnetic to optical size ratio test.

Thus, the coin detection device of the present invention provides a magnetic to optical size ratio test which is effective in distinguishing a smaller size, lower denomination coin from a larger size, higher denomination coin even when the smaller coin has been modified to have the same optical size as the larger coin. This magnetic to optical size ratio test can be utilized alone or in conjunction with other know tests for detecting and validating coins.

DETAILED DESCRIPTION OF THE DRAWINGS

Figure 1:
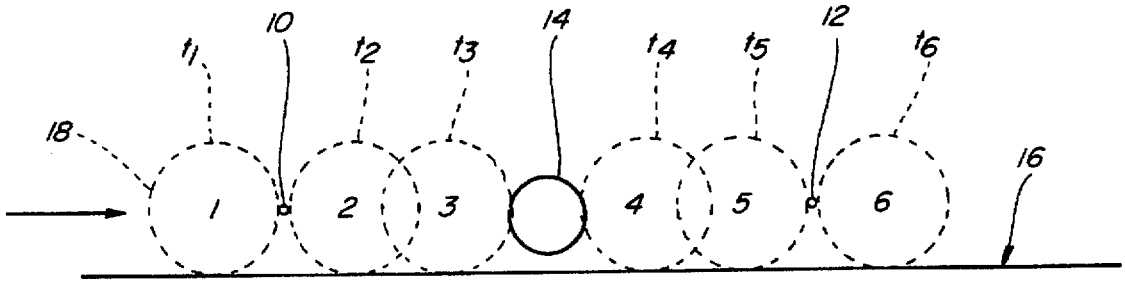
FIG. 1 is a side view of a coin in various positions while traveling along a coin path.

As shown in FIG. 1 a first optical sensor 10, a second optical sensor 12, and a coil 14 are positioned along a coin path 16. The coil 14 is positioned intermediate the optical sensors 10 and 12, however, the coil 14 could also be positioned either to the left of optical sensor 10 or to the right of optical sensor 12. Six positions of a coin 18 traveling from left to right along the coin path 16 are depicted as dashed line circles designated one (1), two (2), three (3), four (4), five (5), and six (6). Position one (1) represents the position of the coin 18 when the coin 18 is first detected by the first optical sensor 10 and position two (2) represents the position of the coin 18 when the coin 18 is last detected by the first optical sensor 10. Associated with the positions are times $t_1$ and $t_2$ which represent the points in time when the coin 18 will be located at positions one (1) and two (2) respectively. Similarly, at position five (5) and time $t_5$ the coin 18 is first detected by the second optical sensor 12 and at position six (6) and time $t_6$ the coin 18 is last detected by the second optical sensor 12. With respect to the coil 14, at position three (3) and time $t_3$ the coin 18 is entering the region of the coil 14 and at position four (4) and time $t_4$ the coin 18 is leaving the region of the coil 14. Position three (3) is representative of when the coin 18 begins to interact with, or reaches a predetermined level of interaction with, the field of the coil 14, and position four (4) is representative of when the coin 18 is no longer interacting at the predetermined level, as may be indicated by various known methods, such as by a change in an output signal of a detection circuit (not shown).

The present invention utilizes a magnetic to optical size ratio to distinguish between different coins and between valid coins and slugs. However, it is understood that the reciprocal of the magnetic to optical size ratio could be used without departing from the scope of the present invention, in which case the ratio would be appropriately termed an optical to magnetic size ratio.

Figure 2:
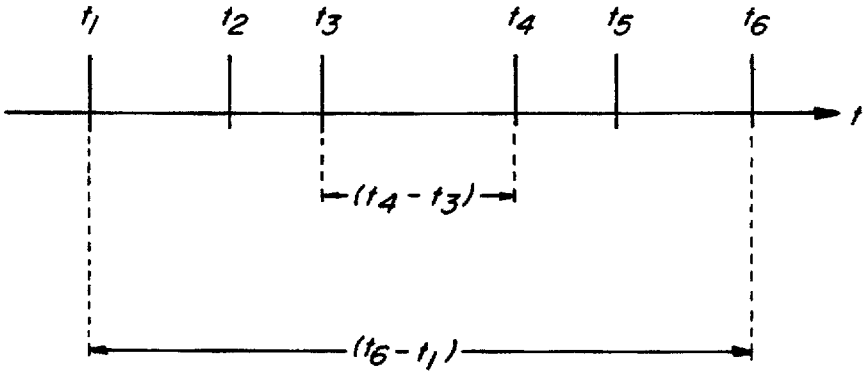
FIG. 2 is a timeline diagram including times corresponding to each of the coin positions illustrated in FIG. 1.

The magnetic to optical size ratio is a ratio of the magnetic size time to the optical size time. The magnetic size time is the time the coin 18 takes to move from position three (3) to position four (4), or $(t_4-t_3)$ as shown in the timeline of FIG. 2. The optical size time is the time the coin 18 takes to move between the two optical sensors 10 and 12, preferably between positions one (1) and six (6), or $(t_6-t_1)$. Further, although not required, it may be desirable to multiply the ratio by a constant K. Thus, the magnetic to optical size ratio ($RATIO_{M/O}$) may be represented by the equation $$RATIO_{M/O}=[(t_4-t_3)/(t_6-t_1)]K.$$

In this ratio, time $t_3$ is dependent upon the position of the leading edge of the coin 18 while time $t_4$ is dependent upon the position of the trailing edge of the coin 18. Therefore, the travel time $(t_6-t_1)$ between positions one (1) and six (6) is preferred for purposes of the optical size time or denominator because time $t_1$ is similarly dependent upon the position of the leading edge of the coin 18 and time $t_6$ is similarly dependent upon the position of the trailing edge of the coin 18. Due to this symmetry between the two time periods, $(t_4-t_3)$ and $(t_6-t_1)$, a ratio of the two is substantially independent of the speed of the coin. Thus, although other travel times such as $(t_5-t_2)$, $(t_5-t_1)$, or $(t_6-t_2)$ could be used in the denominator, the magnetic to optical size ratio is most effective for distinguishing between coins when the travel time $(t_6-t_1)$ is used as the optical size time in the denominator.

Figure 3:
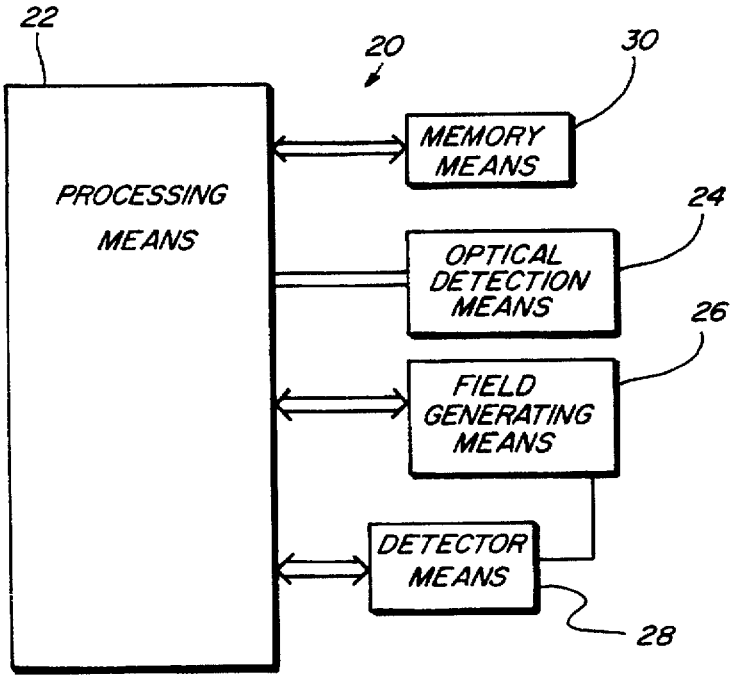
FIG. 3 is a block diagram illustration of the coin detection device of the present invention.

The particular travel times utilized in the magnetic to optical size ratio can be established by the coin detection device 20 illustrated in block diagram form in FIG. 3. The coin detection device 20 includes a processing means 22, such as a microprocessor, connected to an optical detection means 24 which includes the optical sensors 10 and 12 illustrated in FIG. 1. Also connected to the processing means 22 is a field generating means 26 which includes the coil 18 of FIG. 1 and may comprise various known field generating means commonly used in coin detection devices. A detector means 28 is associated with the processing means 22 and the field generating means 26 such that the detector means 28 is able to detect when the coin 18 enters and leaves the region of the coil 14 and its associated field. Again, the detector means 28 utilized may include detector means such those used in known coin detection devices.

The processing means 22 is also connected to a memory means 30 such that the processing means 22 is capable of retrieving stored information therefrom. In operation, the coin detection device 20 establishes the magnetic to optical size ratio described above with reference to FIGS. 1 and 2, and the established magnetic to optical size ratio is evaluated in light of predetermined maximum and minimum ratios for acceptable coins, which maximum and minimum ratios are stored in the memory means 30. In this regard, the coin detection device 20 may be configured to compare the established magnetic to optical size ratio with one set of a predetermined maximum ratio and a predetermined minimum ratio for a single coin type or the coin detection device 20 may be configured to compare the established ratio with a plurality of sets of predetermined maximum and predetermined minimum ratios for a corresponding plurality of coin types. In either case, if the established magnetic to optical size ratio falls between the predetermined maximum and minimum ratios for a particular valid coin type, then the coin being tested is accepted as satisfying the magnetic to optical size ratio test for that particular coin type.

Figure 4:
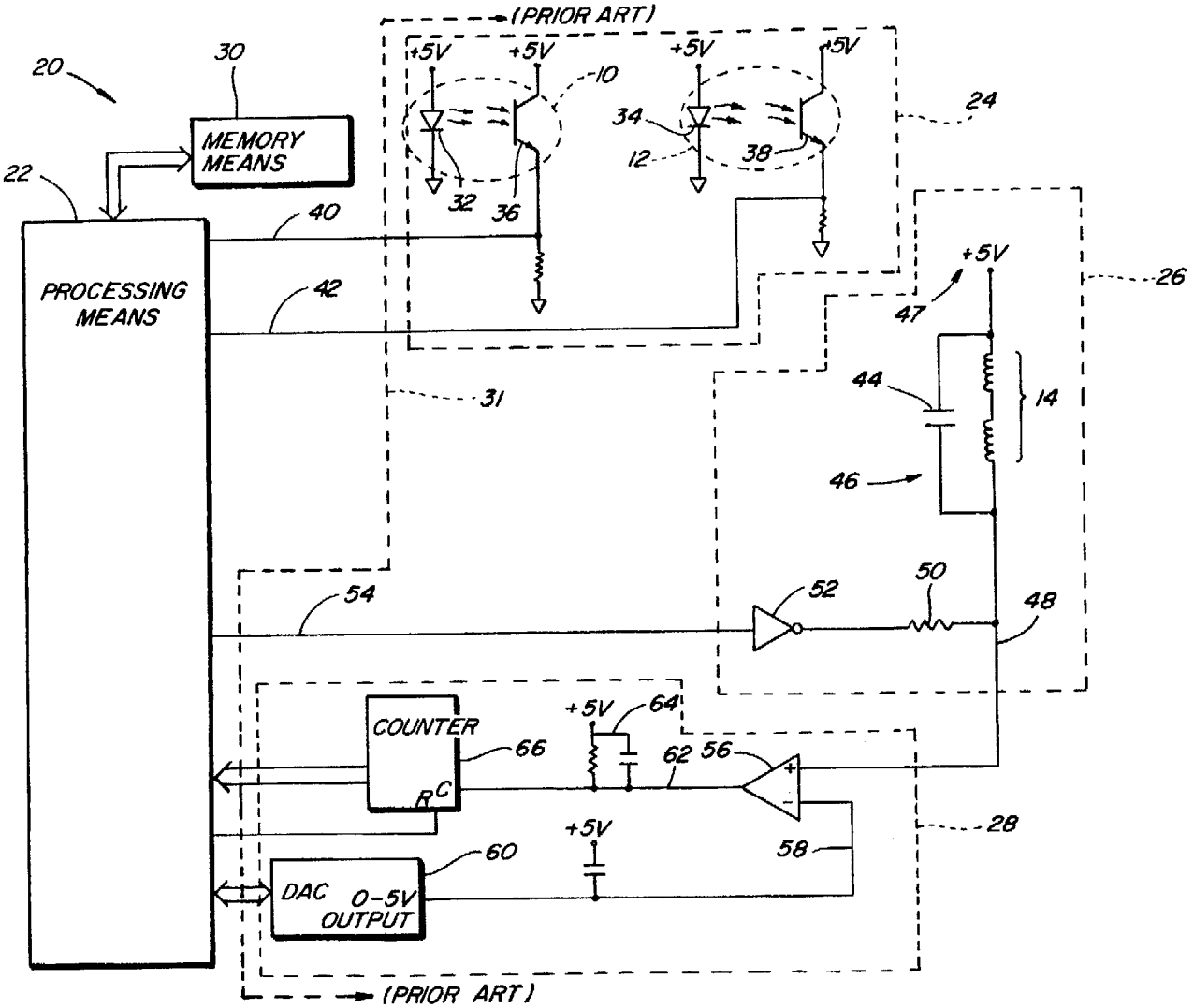
FIG. 4 is a schematic circuit diagram of an embodiment of the coin detection device illustrated in FIG. 2.

FIG. 4 illustrates a schematic circuit diagram of the optical detection means 24, the field generating means 26, and the detection means 28 illustrated in FIG. 3. This particular embodiment is intended for illustration purposes only and it is understood that the implementation of the magnetic to optical size ratio test is not necessarily limited to the FIG. 4 embodiment. The circuitry to the right of line 31 is indicated as prior art. Further, while the processing means 22 and the memory means 30 are not considered structurally new, the programming of the processing means 22 and the information stored in the memory means 30 and used by the processing means 22 result in a novel coin detection device.

The optical detection means 24 includes the optical sensors 10 and 12, each forming an optical coupler pair including a light emitting diode 32 or 34 and corresponding phototransistor 36 or 38. Each light emitting diode 32 and 34 is positioned on one side of the coin path 16, shown in FIG. 1, and each corresponding phototransistor 36 and 38 is positioned on the opposite side of the coin path 16. The optical coupling of each pair places the phototransistor 36 or 38 in a conductive state so that a HI signal is transmitted to the processing means along lines 40 or 42. When a coin passes between an optical coupler pair the optical coupling between the pair is broken and the phototransistor 36 or 38 switches to a non-conductive state such that a LO signal is transmitted to the processing means 22. Thus, each optical sensor 10 and 12, or optical coupler pair, is capable of detecting when a coin passes therebetween. The processing means 22 is programmed to utilize the signals from the optical sensors 10 and 12 to establish the optical size time described above.

The field generating means 26 includes the coil 14 connected in parallel with a capacitor 44 to form a tank circuit 46. The input of the tank circuit 46 is connected to a power supply means 47. The circuit illustrated in FIG. 4 is a modified version of the circuit illustrated and described in FIG. 3 of U.S. Pat. No. 4,625,852. As is evident from the description contained therein, the tank circuit 46 is connected to both an output monitor lead 48 and through a resistor 50 to a driver means 52 whose input is connected to a control link 54. When a LO ring initiation signal is applied to the control line 54, the output of the driver means 52 will go HI causing the tank circuit 46 to be interrupted in such manner that a damped wave output signal is produced on monitor lead 48.

The output monitor lead 48 is connected to the positive input (+) of a voltage comparator 56, the negative input (−) of which is connected to a reference lead 58 which in turn is connected to the output of a digital to analog converter 60 such that a controllable reference voltage is applied to the negative input (−). The output 62 of the voltage comparator 56 is connected to a positive voltage source through a pull-up circuit 64 so that whenever the voltage at the negative input (−) is less than the voltage of the positive input (+), a HI signal is ensured at the output 62. When the tank circuit 46 is rung so as to provide a damped wave output signal as described above, the damped wave signal is compared against the reference voltage and the output 62 is fed into a counter 66. Each time the damped signal voltage drops below the reference voltage a count is triggered in the counter 66. For purposes of the present invention the reference voltage can be chosen such that when the counter 66 counts a predetermined number (m) for a ringing operation, the count number (m) is indicative of the coin 18 having entered the region of the coil 14 or of the coin 18 having reached a predetermined level of interaction with the field of the coil 14. Similarly, when the coin 18 leaves the region of the coil 14 the count for a ringing operation will no longer reach the predetermined count number (m). Thus, the coin detection device 20 is able to detect when the coin 18 enters the region of the coil 14 and when the coin 18 leaves the region of the coil 14. The reference voltage and/or count number (m) may be varied as desired to detect different levels of interaction between the coin 18 and the coil 14.

With respect to the ringing of tank circuit 46, it is understood that the detection of a coin by optical sensor 10, shown in FIG. 1, could be utilized to initiate a series of ringing operations. However, the tank circuit 46 could also be continuously rung regardless of whether or not a coin is traveling along the coin path 16.

Based upon signals from the counter 66, the processing means 22 is operable to establish the magnetic size time described above. Once both the magnetic size time and the optical size time have been established, the processing means 22 then establishes the magnetic to optical size ratio and evaluates the ratio in light of the predetermined maximum and minimum ratios stored in the memory means 30.

Figure 5:
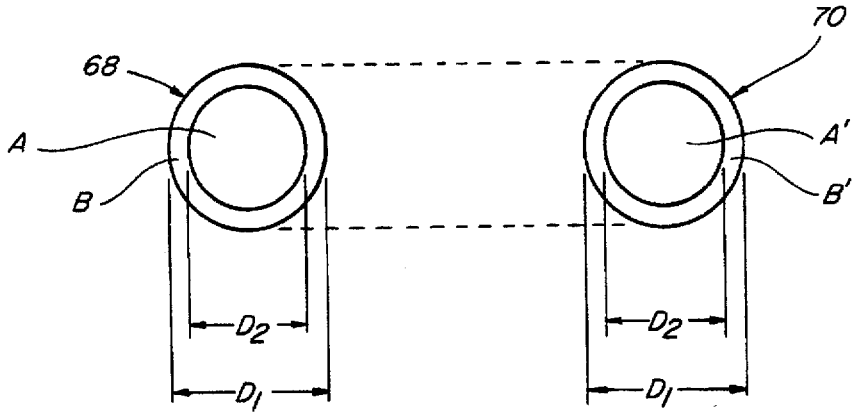
FIG. 5 is a side view of two coins formed of similar metals.

The advantage of the present invention can be seen with reference to FIG. 5 which illustrates a first ringed coin 68 and a second ringed coin 70. The first coin 68 includes an inner portion A formed of Copper (Cu) and an outer portion B formed of Nickel (Ni). The second coin 70 includes an inner portion A' formed of Ni and an outer portion B' formed of Cu. Thus, the coins have similar metallic content, although the location of the particular metals is reversed. As illustrated, the optical size of the first coin 68 is the same as the optical size of the second coin 70, both D1. With respect to magnetic size, however, because Ni will have a greater effect than Cu on the coil 14 and its associated circuit, the magnetic size time for the first coin 68 will be longer than the magnetic size time for the second coin 70. Accordingly, the magnetic to optical size ratio of the first coin 68 will be different than the magnetic to optical size ratio of the second coin 70 and the coin detection device 20 will be able to distinguish between the first coin 68 and the second coin 70.

Figure 6:
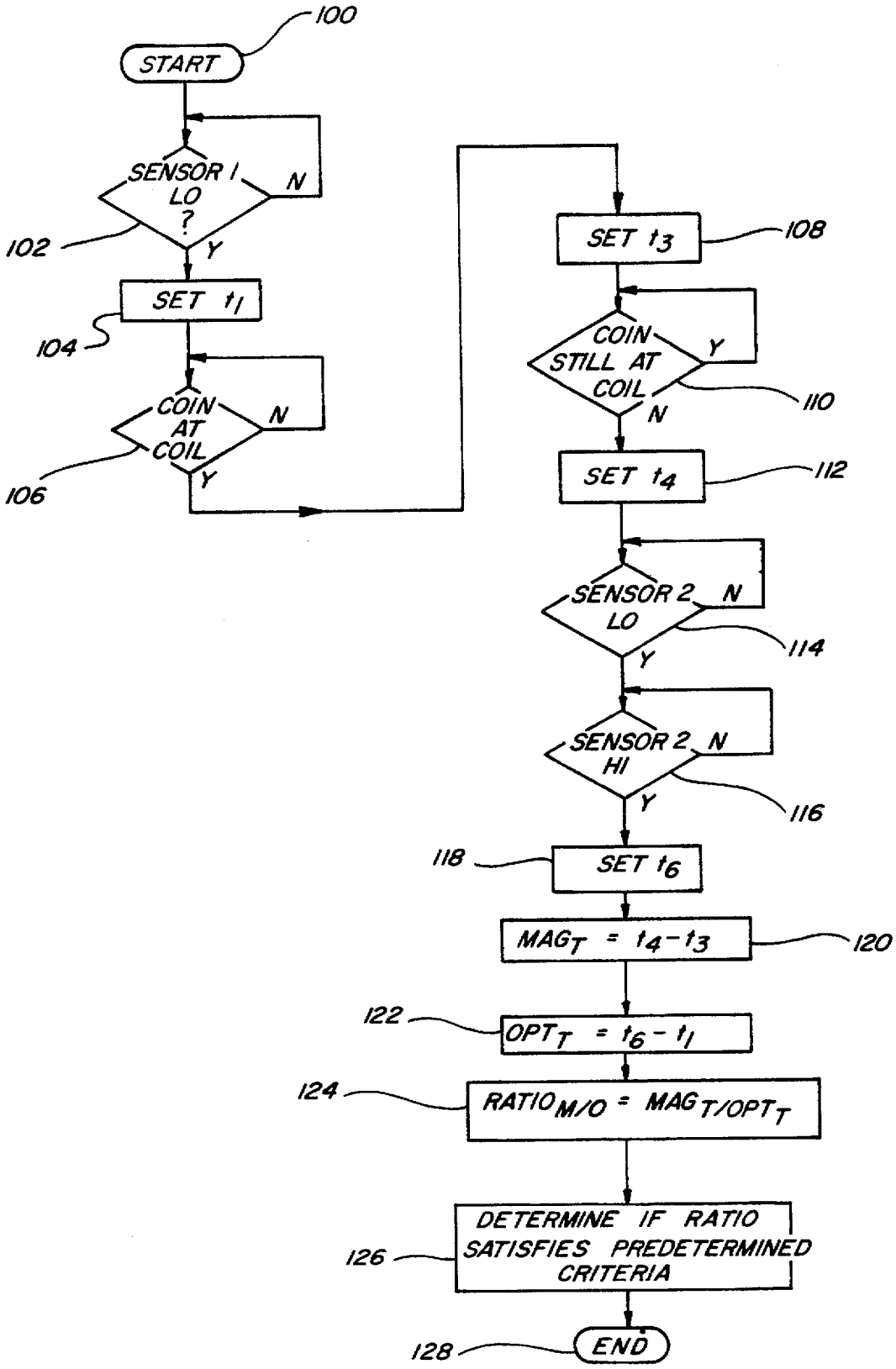
FIG. 6 is a flow chart illustration of a sequence of processing steps for the subject coin detection device.

FIG. 6 illustrates a sequence of processing steps which could be programmed into processing means 22. The particular processing steps shown would be utilized with the sensor configuration shown in FIG. 1, where the coil 14 is located intermediate the optical sensors 10 and 12. Also, the processing steps illustrated in FIG. 6 implement an optical size time based on positions six (6) and one (1) of the coin 18. It is understood that other processing steps could be utilized and that numerous routines could be incorporated into each processing step depending upon the particular sensor configuration of the coin detection device and also depending upon the optical size time which is being implemented.

The sequence starts at 100 and moves to step 102. When the coin reaches position one (1), see FIG. 1, the optical coupling of the first optical sensor is blocked and the signal sent to the processing means 22 along line 40, see FIG. 4, goes LO and processing moves to step 104 where time $t_1$ is set. When the coin 18 begins to interact with the field of the coil at position three (3), decision step 106 is satisfied and time $t_3$ is set at step 108. When the coin no longer interacts with the field of the coil at position four (4), decision step 110 is no longer satisfied and time $t_4$ is set at step 112. When the coin reaches position five (5), decision step 114 is satisfied and processing moves to step 116. When the coin reaches position six (6), decision step 116 is satisfied and time $t_6$ is set at step 118. At step 120 the magnetic size time ($MAG_T$) is determined and at step 122 the optical size time ($OPT_T$) is determined. The magnetic to optical size ratio is then determined at step 124 and at step 126 the magnetic to optical size ratio is evaluated to see if it satisfies predetermined criteria of a valid coin type. Processing then ends at step 128.

Figure 7:
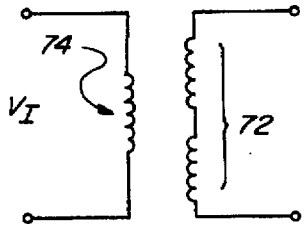
( PRIOR ART ) Fig. 7
FIG. 7 is an illustration of a driving coil and a sensing coil in coupling relation to each other.
Figure 8:
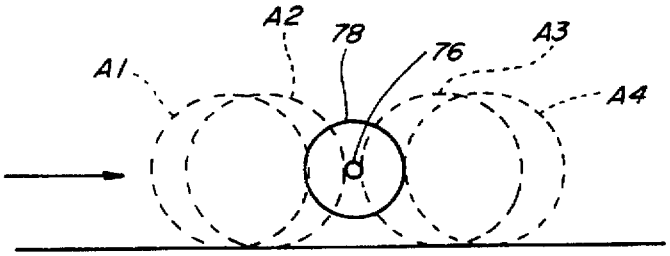
FIG. 8 is a side view of a coin in various positions while traveling along a coin path.

As previously explained, the optical detection means 24, field generating means 26 and detector means 28 could include numerous known constructions common to existing coin detection devices. For example, the field generating means could include a driving coil 72 as illustrated in FIG. 7 while the detector means could include an associated sensing coil 74 in which a voltage $V_I$ is induced by the generated field. In this configuration, which is well known in the art, the level of interaction of the coin with the field of the driving coil 72 would be indicated by changes in the voltage $V_I$ induced in the sensing coil 74. Further, the optical detection means could be a single optical sensor 76 such as that illustrated within the coil 78 of FIG. 8, the coil 78 being wound on a core within which the optical sensor 76 is located. In this embodiment, the magnetic to optical size ratio would be based upon coin positions A1, A2, A3, and A4 as represented by the equation $$RATIO_{M/O}=[(t_{A4}-t_{A1})/(t_{A3}-t_{A2})]K.$$

Moreover, the optical sensor 76 could also be located to one side of the coil 78.

From the preceding description, it is evident that the objects of the invention are attained. In particular, a coin detection device which is capable of distinguishing between coins of similar metallic content without relying solely on optical size testing has been provided. Further, a method of coin detection which can be implemented utilizing various known coin validation and/or detection devices has also been provided. Although the invention has been described and illustrated in detail, it is to be clearly understood that the same is intended by way of illustration and example only and is not to be taken by way of limitation. For example, the coin detection method of the present invention could be implemented in many existing coin validation and/or detection devices. Accordingly, the spirit and scope of the invention are to be limited only by the terms of the appended claims.

What is claimed is:

1. A coin detection device for detecting a coin as it moves along a coin path comprising means for determining a first time period, said first time period being dependent upon the diameter of the coin being tested, means for determining a second time period, said second time period being dependent upon the material of the coin being tested, means for establishing a ratio of said first and second time periods, said means for determining a first time period including at least one optical sensor located along said coin path and positioned to detect movement of a coin thereby, and said means for determining a second time period including a coil located along said coin path, said coil connected to a power supply means so as to be energizable to generate an electromagnetic field in the region of said coin path.

2. The coin detection device according to claim 1 wherein said means for determining a first time period includes processing means connected to said optical sensor, said first time period running from when the leading edge of the coin is detected by said optical sensor to when the trailing edge of the coin is detected by said optical sensor.

3. The coin detection device according to claim 2 wherein said second time period runs from when the coin enters the region of said coil to when the coin leaves the region of said coil.

4. The coin detection device according to claim 1 wherein said at least one optical sensor comprises first and second optical sensors, and said means for determining a first time period includes processing means connected to said first and second optical sensors, said first time period running from when the leading edge of the coin is detected by said first optical sensor to when the trailing edge of the coin is detected by said second optical sensor.

5. The coin detection device according to claim 4 wherein said second time period runs from when the coin enters the region of said coil to when the coin leaves the region of said coil.

6. The coin detection device according to claim 5 wherein said coil is located intermediate said first and second optical sensors.

7. The coin detection device according to claim 1 further comprising means for determining if said ratio is indicative of a valid coin type.

8. The coin detection device according to claim 7 wherein said means for determining if said ratio is indicative of a valid coin type includes memory means for storing a plurality of predetermined ratios, processing means connected to said memory means and capable of retrieving stored information therefrom, said processing means programmed to compare said established ratio with at least one of said plurality of stored predetermined ratios.

9. A device for validating a coin moving along a coin path, comprising first and second spaced optical sensors positioned along the coin path and capable of detecting movement of the coin thereby, a coil located along the coin path, means for detecting the coin as the coin enters the region of the coil and as the coin leaves the region of the coil, processing means operably connected to said first optical sensor, said second optical sensor and said means for detecting the coin, said processing means operable to establish a ratio of a first time period and a second time period, said first time period running from when the coin enters the region of the coil to when the coin leaves the region of the coil and said second time period being the time the coin takes to travel from said first optical sensor to said second optical sensor.

10. The device according to claim 9 wherein said ratio established by said processing means is a ratio of said first time period to said second time period.

11. The device according to claim 9 wherein said ratio established by said processing means is a ratio of said second time period to said first time period.

12. The device according to claim 9 wherein said second time period runs from when the leading edge of the coin is detected by said first optical sensor to when the trailing edge of the coin is detected by said second optical sensor.

13. The device according to claim 9 wherein said second time period runs from when the trailing edge of the coin is detected by said first optical sensor to when the leading edge of the coin is detected by said second optical sensor.

14. The device according to claim 9 further comprising memory means for storing at least one set of predetermined ratios including a predetermined maximum ratio and a predetermined minimum ratio for at least one valid coin type, said processing means connected to said memory means and capable of retrieving stored information therefrom, said processing means operable to determine if said established ratio falls within a predetermined range as defined by said predetermined maximum ratio and said predetermined minimum ratio for the valid coin type.

15. The device according to claim 9 further comprising memory means for storing a plurality of sets of predetermined ratios, each set including a predetermined maximum ratio and a predetermined minimum ratio for a valid coin type, said processing means connected to said memory means and capable of retrieving stored information therefrom, said processing means operable to determine if said established ratio falls within one of a plurality of predetermined ranges, each predetermined range defined by one of said plurality of sets of predetermined ratios.

16. The device according to claim 9 wherein said coil is positioned intermediate said first and second optical sensors along the coin path.

17. The device according to claim 9 wherein said coil is connected to form part of a tank circuit, said tank circuit fed by a power supply means and connected to means for ringing said tank circuit such that said tank circuit outputs a damped wave signal.

18. The device according to claim 17 wherein said means for detecting the coin as the coin enters the region of the coil and as the coin leaves the region of the coil comprises a comparator including one input connected in series with said tank circuit so as to receive said damped wave output signal, and means for applying a reference voltage to a second input of said comparator.

19. The device according to claim 18 wherein said means for detecting the coin as the coin enters the region of the coil and as the coin leaves the region of the coil further comprises a counter connected to said processing means, the output of said comparator being connected to the input of said counter.

20. A coin detection device comprising optical detection means capable of detecting movement of a coin thereby, field generating means including a conductive coil energizable to generate an electromagnetic field in the region of the coin as it passes thereby, detector means configured to detect when the interaction of the coin with said field of said conductive coil first reaches a predetermined level and when the interaction of the coin with said field of said conductive coil falls below said predetermined level, processing means connected to said optical detection means and said detector means, said processing means operable to establish a magnetic size time and an optical size time, said magnetic size time running from when the interaction of the coin with said electromagnetic field first reaches said predetermined level to when the interaction of the coin with said electromagnetic field falls below said predetermined level, said optical size time being the time the coin takes to pass by said optical detection means, and said processing means operable to establish a ratio of said magnetic size time and said optical size time.

21. The coin detection device according to claim 20 wherein said optical detection means comprises an optical sensor, said optical size time running from when the leading edge of the coin is detected by said optical sensor to when the trailing edge of the coin is detected by said optical sensor.

22. The coin detection device according to claim 20 wherein said optical detection means comprises first and second optical sensors, said optical size time running from when the coin is detected by said first optical sensor to when the coin is detected by said second optical sensor.

23. The coin detection device according to claim 20 wherein said processing means is programmed to establish a ratio of said magnetic size time to said optical size time.

24. The coin detection device according to claim 23 further comprising memory means storing a plurality of predetermined ratios, said processing means connected to said memory means and capable of retrieving stored information therefrom, said processing means programmed to compare said established ratio to at least one of said plurality of stored predetermined ratios.

25. The coin detection device according to claim 24 wherein said plurality of stored predetermined ratios includes a predetermined maximum ratio and a predetermined minimum ratio corresponding to at least one valid coin type, said processing means programmed to determine if said established ratio falls within said predetermined maximum ratio and said predetermined minimum ratio.

26. The coin detection device according to claim 20 wherein said processing means is programmed to establish a ratio of said optical size time to said magnetic size time.

27. The coin detection device according to claim 20 wherein said detector means comprises a sensing coil positioned such that said electromagnetic field of said conductive coil induces a signal in said sensing coil.

28. The coin detection device according to claim 20 wherein said detector means comprises a detection circuit connected to said conductive coil.

29. The coin detection device according to claim 28 wherein said detection circuit comprises a comparator and a counter, said conductive coil connected in series with one input of said comparator, and the output of said comparator connected in series with the input of said counter.

30. A method of validating a coin in a coin detection device utilizing both optical size detection and magnetic size detection, said method comprising the steps of:

establishing a first time period which is dependent upon the diameter of the coin being tested based upon optical detection of the coin;

establishing a second time period which is dependent upon the material from which the coin is formed based upon magnetic detection of the coin;

establishing a ratio of said first and second time periods; and comparing said established ratio with at least one predetermined ratio.

31. The method of validating a coin according to claim 30 wherein said step of establishing a ratio of said first and second time periods further includes multiplying said ratio by a constant.

32. The method of validating a coin according to claim 30 wherein the coin detection device includes an optical sensor, said step of establishing a first time period including the optical sensor generating a signal which changes in response to the coin having reached the optical sensor and changes in response to the coin having left the optical sensor, said first time period running from when the coin reaches the optical sensor to when the coin leaves the optical sensor.

33. The method of validating a coin according to claim 30 wherein said coin detection device includes first and second optical sensors, said step of establishing a first time period including the first optical sensor generating a first signal indicative of the coin having reached the first optical sensor and the second optical sensor generating a second signal indicative of the coin having left the second optical sensor, said first time period running from the time of said first signal to the time of said second signal.

34. The method of validating a coin according to claim 30 wherein said step of comparing said established ratio with at least one predetermined ratio includes comparing said established ratio with at least one predetermined maximum ratio for a valid coin type and at least one predetermined minimum ratio for the same valid coin type.

35. The method of validating a coin according to claim 30 wherein the coin detection device includes field generating means including a coil energizable to generate an electromagnetic field, detector means for detecting the interaction of the coin with the field of the coil, said step of establishing said second time period including determining when the coin first reaches a predetermined level of interaction with the field of the coil and when the coin last reaches said predetermined level of interaction with the field of the coil.

36. A device for validating a coin moving along a coin path, comprising first and second spaced optical sensors positioned along the coin path and capable of detecting movement of the coin thereby, a coil located along the coin path, means for detecting the coin as the coin enters the region of the coil and as the coin leaves the region of the coil, processing means operably connected to said first optical sensor, said second optical sensor and said means for detecting the coin, said processing means operable to establish a ratio of a first time period and a second time period, said first time period running from when the coin enters the region of the coil to when the coin leaves the region of the coil and said second time period being the time the coin takes to travel from said first optical sensor to said second optical sensor, wherein said coil is connected to form part of a tank circuit, said tank circuit fed by a power supply means and connected to means for ringing said tank circuit such that said tank circuit outputs a damped wave signal.

* * * * *